US007862444B2

(12) United States Patent
Jones

(10) Patent No.: US 7,862,444 B2
(45) Date of Patent: Jan. 4, 2011

(54) GOLF SWING TRAINING DEVICE

(75) Inventor: Herman L. Jones, Marysville, WA (US)

(73) Assignee: Jones Rutherford LLC, Arlington, WA (US)

( * ) Notice: Subject to any disclaimer, the term of this patent is extended or adjusted under 35 U.S.C. 154(b) by 0 days.

(21) Appl. No.: 12/710,962

(22) Filed: Feb. 23, 2010

(65) Prior Publication Data

US 2010/0151958 A1 Jun. 17, 2010

Related U.S. Application Data

(60) Continuation of application No. 11/533,721, filed on Sep. 20, 2006, now Pat. No. 7,670,233, which is a division of application No. 11/155,710, filed on Jun. 17, 2005, now Pat. No. 7,144,340.

(51) Int. Cl.
*A63B 69/36* (2006.01)

(52) U.S. Cl. ..... 473/257; 473/229

(58) Field of Classification Search ..... 473/226, 473/229, 257, 258, 259, 261
See application file for complete search history.

(56) References Cited

U.S. PATENT DOCUMENTS

| | | | |
|---|---|---|---|
| 1,399,761 | A | 12/1921 | Garland |
| 1,567,530 | A | 12/1925 | Macnaughton et al. |
| 1,633,527 | A | 6/1927 | Hansen |
| 1,634,102 | A | 6/1927 | Hansen |
| 1,670,409 | A | 5/1928 | Hansen |
| 1,854,392 | A | 5/1932 | Bambrick |
| 1,960,787 | A | 5/1934 | Macstocker |
| 2,520,287 | A | 8/1950 | Plunkett et al. |
| 2,653,025 | A | 9/1953 | Zega |
| 3,339,927 | A | 9/1967 | Nunn |
| 3,489,416 | A | 1/1970 | Mark |
| 3,711,103 | A | 1/1973 | Seltzer |
| 3,794,329 | A | 2/1974 | Wilson |
| 3,795,399 | A | 3/1974 | Beckish |
| 4,071,251 | A | 1/1978 | Beckish |
| 5,069,456 | A | 12/1991 | Bellagamba |
| 5,439,225 | A | 8/1995 | Gvoich et al. |
| 5,467,993 | A | 11/1995 | Higginson |
| 5,895,327 | A | 4/1999 | Francisco |
| 5,984,798 | A | 11/1999 | Gilmour |
| 6,165,079 | A | 12/2000 | Czaja |
| 6,273,826 | B1 | 8/2001 | Bauer |
| 6,364,786 | B1 | 4/2002 | Khano |
| 6,582,319 | B2 | 6/2003 | Czaja |
| 7,074,133 | B1 | 7/2006 | Jones et al. |
| 7,144,340 | B1 | 12/2006 | Jones |

*Primary Examiner*—Nini Legesse
(74) *Attorney, Agent, or Firm*—Dwayne E. Rogge; Hughes Law Firm, PLLC

(57) ABSTRACT

In general, this disclosure relates to a golf swing training device, comprises three interoperating portions, the first portion of the device being an active area, the second being a collapsible frame, and the third being a golf club-like device and carriage. The collapsible base frame allows the active area to be repositioned from a fully upright orientation, to a partially lowered orientation, and continue to a significantly lowered orientation, to a fully lowered (collapsed) orientation. In the fully lowered orientation, the device has a much smaller profile and can therefore be more easily transported and stored.

14 Claims, 12 Drawing Sheets

GOLF SWING TRAINING DEVICE

RELATED APPLICATIONS

This Continuation in Part application claims priority of the Continuation in Part U.S. Ser. No. 11/533,721, filed on Sep. 20, 2006, now U.S. Pat. No. 7,670,233 which claimed priority of the divisional application Ser. No. 11/155,710 filed Jun. 17, 2005, now U.S. Pat. No. 7,144,340 B1, published on Dec. 5, 2006, which claimed priority of U.S. Pat. No. 7,074,133 B1, published on Jul. 11, 2006.

BACKGROUND OF THE DISCLOSURE a) Field of the Disclosure

This application generally relates to the field of golf training aids, specifically stationary training aids to improve a golfer's first swing through repetition in a controlled environment.

SUMMARY OF THE DISCLOSURE

Disclosed herein is an improved, collapsible, and adjustable frame for a golf swing training device. The golf swing training device has an active area and a collapsible frame comprising several elements, including a base platform operatively configured to rest on a support surface, and four linkages. The first linkage has a first end, a second end and a medial portion, wherein the first end of the first linkage is rotatably coupled to the base platform. The second linkage has a first end and a second end, wherein the first end of the second linkage is slidably and rotatably coupled to the base platform and the second end of the second linkage is rotatably coupled to the medial portion of the first linkage. The third linkage has a first end, a second end, and a medial portion, wherein the first end of the third linkage is rotatably coupled to the median portion of the second linkage, wherein the third linkage is substantially parallel to the first linkage. The fourth linkage has a first end, a medial portion, and a second end, wherein the first end of the fourth linkage is coupled to the second end of the third linkage, and the medial portion of the fourth linkage is coupled to the active area of the golf swing training device; and wherein the collapsible frame supports a rail frame of the active area of the golf swing training device and provides vertical adjustability between the support surface and the rail frame.

In one form, the golf swing training device described above further comprises an adjustable linkage mechanism between the active area of the golf swing training device and the medial portion of the fourth linkage. In one embodiment, the adjustable linkage comprises a threaded rod to allow for further adjustability of the frame. In another embodiment, the collapsible frame for a golf swing training device is constructed wherein the rail frame of the active area forms a plane at an angle of between 50 and 70 degrees from the angle of the support surface when in a fully upright position and wherein the active area is substantially parallel to the support surface when in a fully lowered position. The device may also be constructed wherein a gas spring is operatively configured to offset the weight of the active area as the height of the collapsible frame is adjusted. To further enable the frame to collapse in one form, the frame may comprise a release catch, which retains the golf swing training device in the storage position when the release catch is engaged and wherein the release catch couples the rail frame to the base frame when engaged. To support the device, a cross member having a first end, a medial portion and a second end may be utilized, wherein the medial portion of the cross member is fixedly coupled to the medial portion of the fourth linkage, wherein the first end of the cross member is rotatably coupled to the second end of the first linkage, and wherein the second end of the cross member is rotatably coupled to the active area.

To further improve adjustability of the frame, the collapsible frame may further comprise a gear rack mounted to the base platform and a pawl rotatably mounted to the collapsible frame, operatively configured to engage the gear rack and maintain the active area in a desired vertical position. Additionally, the collapsible frame may also further comprise a frame attachment slide positionably coupled to the rail frame and a backswing adjuster rotatably coupled to the frame attachment slide, wherein the backswing adjuster is coupled to at least one rail of the active area.

The collapsible frame for a golf swing training device may be improved with additional components, comprising a frame attachment slide positionably coupled to the rail frame and a follow through adjuster rotatably coupled to the frame attachment slide, wherein the follow through adjuster is coupled to at least one rail of the active area.

A golf swing apparatus adapted to train a golf student on their golf swing, where the golf swing of the student has rearward and forward swing directions and various swing positions. The golf swing apparatus comprises a frame arranged to support a first rail and a second rail, the first and second rails defining a swing plane, and a carriage, having a first attachment region and a second attachment region, where the first attachment region is arranged to be slidably attached to the first rail and the second attachment region is arranged to be slidably attached to the second rail. The first and second attachment regions are positioned at a substantially fixed distance from one another on the carriage. The carriage is further operatively configured to receive a golf club like handle, having an upper connection portion pivotally attached to the first attachment region of the carriage and a lower connection portion pivotally connected to the second attachment region. In one form, the carriage can be arranged to reposition in a rearward swing direction and a forward swing direction, whereby the distance between the first rail and the second rail in the swing plane fluctuates with respect to the location of the carriage at various swing positions. The said distance between the first and second rail at various swing positions may dictate the pitch of the carriage and handle substantially about a forward-rearward axis, providing the golf student with a desired golf swing. At least one gap adjuster in one form has a first portion coupled to the first rail and a second portion coupled to the second rail, wherein the distance between the first portion and the second portion can be adjusted.

The golf swing apparatus may also comprise at least one gap separation slide, comprising a first portion fixed to the first rail, a second portion fixed to the second rail, and a guide portion allowing the first portion and second portion to reposition relative to one another along an axis substantially parallel to the tangent of the second rail at the second portion. The golf swing apparatus may also be arranged such that a first frame attachment slide is coupled to the frame, a backswing adjuster is rotatably coupled to the first frame adjustment slide and coupled to the first rail or second rail at a backswing portion of the golf swing apparatus, a second attachment slide is coupled to the frame, and a follow-through adjuster is rotatably coupled to the second frame adjustment slide and coupled to the first rail or second rail at a follow-through portion of the golf swing apparatus.

The golf swing apparatus may be assembled such that an overswing preventer is coupled to the rail frame, at least one roller is coupled to the carriage, and wherein the roller engages the overswing preventer to prevent the carriage from incorrectly engaging the first and second rails.

BRIEF DESCRIPTION OF THE DRAWINGS

FIGS. 14 and 15 are detailed views of one embodiment of an over-swing protector in.

DESCRIPTION OF THE PREFERRED EMBODIMENTS

This application claims priority to and incorporates by reference U.S. Pat. Nos. 7,074,133, 7,144,340 and U.S. patent application Ser. No. 11/533,721.

Figure 1:
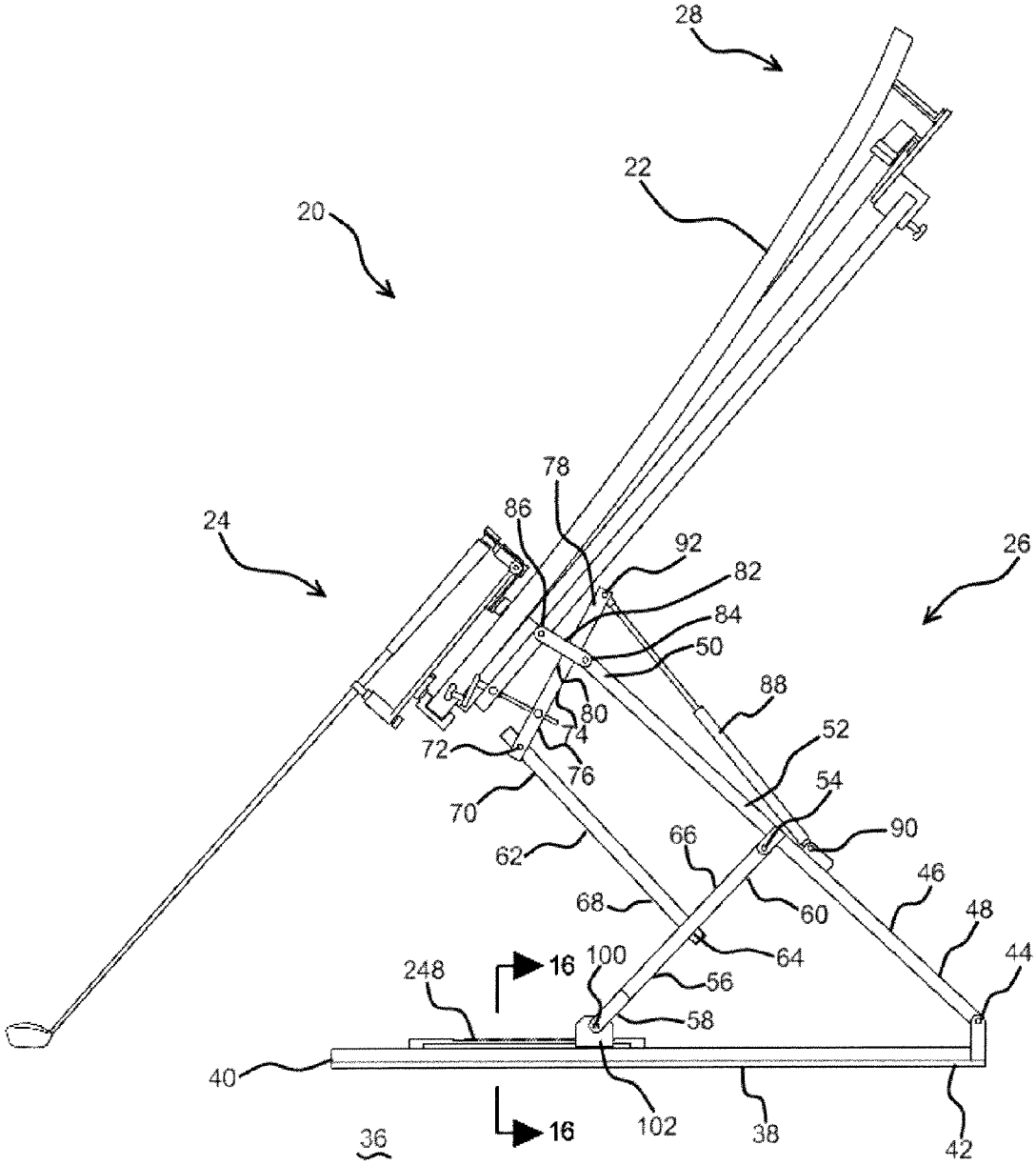
FIG. 1 is a side view of one embodiment in a fully upright orientation.
Figure 2:
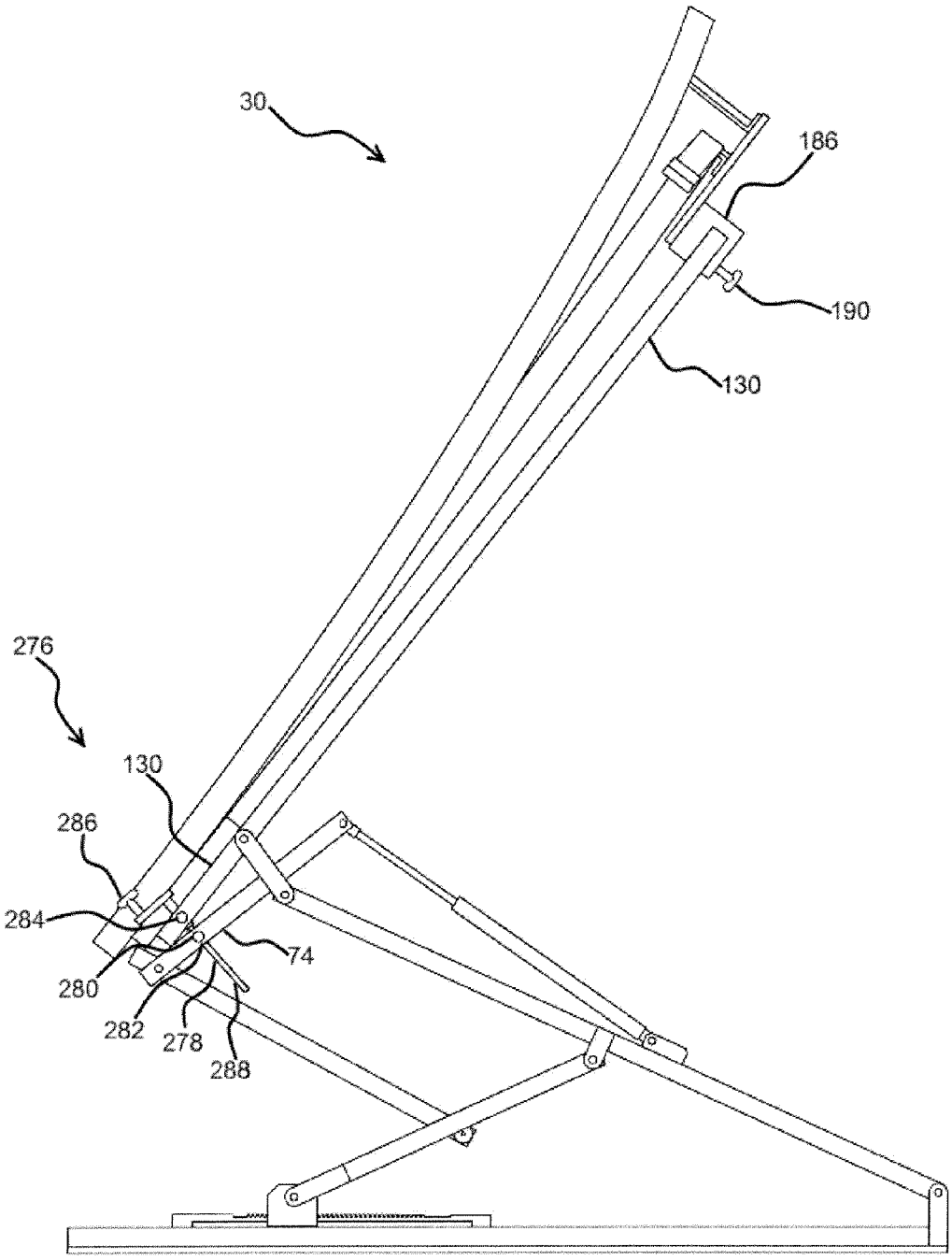
FIG. 2 is a side view of one embodiment in a partially lowered orientation.
Figure 3:
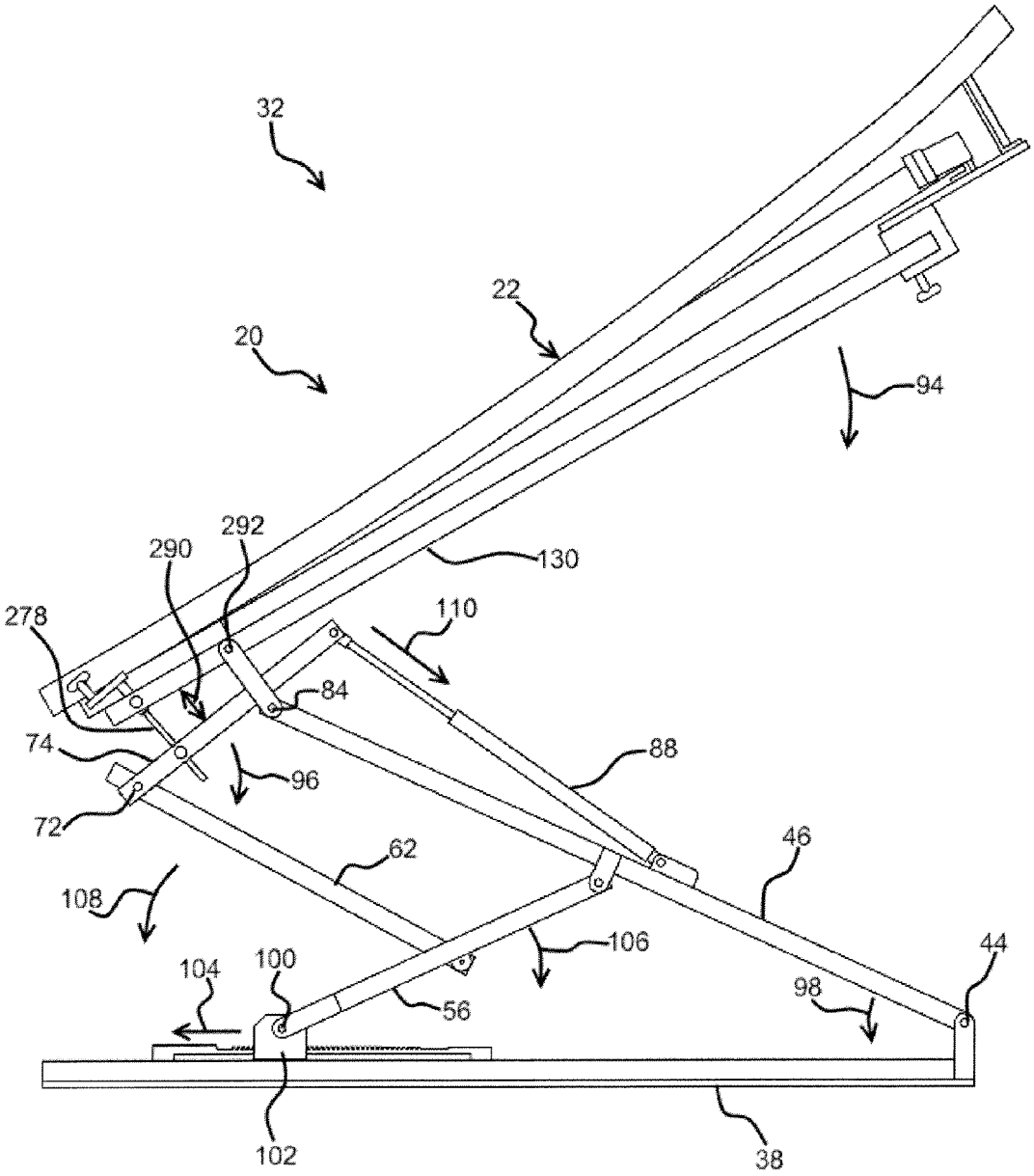
FIG. 3 is a side view of one embodiment in a significantly lowered orientation.
Figure 4:
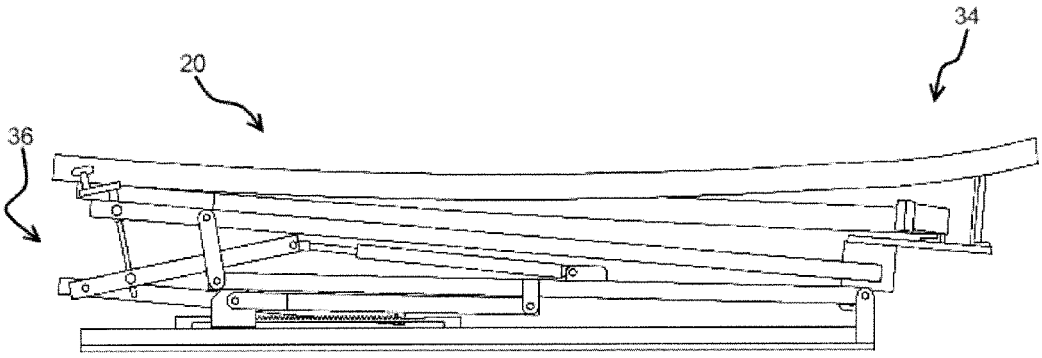
FIG. 4 is a side view of one embodiment in a fully lowered or collapsed orientation.

In general, this disclosure relates to a golf swing training device, which in one embodiment, shown in FIG. 1, comprises three interoperating portions. The first portion of the device 20 being an active area 22, the second being a collapsible frame 26 and the third being a golf club-like device attached to a carriage 24. The active area 22 and the golf club-like device and carriage 24 are very similar to applicant's prior U.S. Pat. No. 7,074,133, incorporated herein by reference with substantial and novel modifications. The collapsible base frame 26, also shown in FIGS. 1-4, allows the active area 22 to be repositioned from a fully upright orientation 28, shown in FIG. 1, to a partially lowered orientation 30, as shown in FIG. 2, and continue to a significantly lowered orientation 32, as shown in FIG. 3, to a fully lowered (collapsed) orientation 34, as shown in FIG. 4. In the fully lowered orientation 34, the device 20 has a much smaller profile and can therefore be more easily transported and stored. For example, the device 20, in the fully lowered orientation 34, can be rotated upwards to rest upon the forward edge 36, perhaps upon wheels or other conveyance, where it would easily fit through a standard doorway. It was not possible to accomplish this orientation with prior embodiments. To allow the base frame 26 to collapse, a multitude of pivots and linkages are utilized. In one form, each of the linkages is formed by a plurality of voids with a bolt or similar fastener connected therethrough. In one form, each of the linkages is formed by a rigid material, such as extruded steel, which allows for the linkages to provide compression and extension resistance as the active area 22 is lifted and lowered. A detailed description of each of these pivots and linkages follow. Still referring to FIG. 1, the collapsible base frame 26 is configured to rest upon a support surface or ground. A base platform 38 is provided as a portion of the collapsible frame 26 which in one form is a planar structure upon which a golf student would stand. In this way, the weight of the golf student helps maintain the device 20 in position during operation. The base platform 38 comprises a front end 40 and a back end 42. At the back end 42 of the base platform 38 is a rear base pivot 44, which attaches a first linkage 46 to the base platform 38. The first linkage 46 comprises a first end 48, including the rear base pivot 44 and a second end 50. A median portion 52 of the first linkage 46 comprises a pivot 54, which rotatably attaches a second linkage 56 to the first linkage 46. Once again, the second linkage 56 comprises a first end 58 positionably attached to the base platform 38 in a manner to be disclosed later, and a second end 60, comprising the pivot 54. A third linkage 62 is attached by way of a pivot 64 to a median portion 66 of the second linkage 56. The third linkage 62 also comprises a first end 68 and second end 70. The second end 70 comprises a pivot 72, which couples the third linkage 62 to a fourth linkage 74. The fourth linkage 74 completes the four bar linkage arrangement. The fourth linkage 74 also comprises a first end 76, a second end 78 and a median portion 80. In one form, the median portion 80 is fixedly coupled to a cross member 82, having a first end 84 and second end 86, wherein the first end 84 couples to the second end 50 of the first linkage 46. To make the device 20 easier to raise and lower, a gas spring 88 may be provided, coupled at a lower spring pivot 90, to the first linkage 46, and connected at an upper spring pivot 92 to the fourth linkage 74. The gas spring 88 provides compressive force between the first linkage 46 and fourth linkage 74, as will be described.

In FIG. 3, the golf swing device 20 is shown in a significantly lowered orientation 32, which allows for an easier discussion of how the collapsible base frame 26 operates. By looking at the sequence shown in FIGS. 1-4, it can be appreciated that as the active area 22 is pressed downward, it tends to rotate slightly along arc 94. As it does so, the fourth linkage 74 rotates along arc 96 about pivots 72 and 84. As the active area 22 is coupled to the upper linkage 74, these two portions lower and rotate together. The adjustment between the active area 22 and fourth linkage 74 is accomplished through other means, which will be discussed and defined. Continuing with the lowering operation, as the fourth linkage 74 lowers and rotates along arc 96, the first linkage 46 will rotate about the rear base pivot 44 relative to the base platform 38 along arc 98. This is possible as the second linkage 56 is attached to the base platform 38 through a pivot 100 and a slide 102. The operation of the slide 102 will also be discussed in more detail. As the slide 102 repositions along direction of travel 104 relative to the base platform 38, the second linkage 56 repositions along arc 106, while the third linkage 62 repositions along arc 108. The weight of the active area 22 and a slight downward force upon the active area 22 overcomes the compression (extension) force exerted by the gas spring 88 to allow the gas spring 88 to compress along compression line 110. In one form, a catch or tie may be utilized between the active area 22 and the base platform 38 to maintain the device 20 in a fully lowered orientation 34, as shown in FIG. 4.

Figure 5:
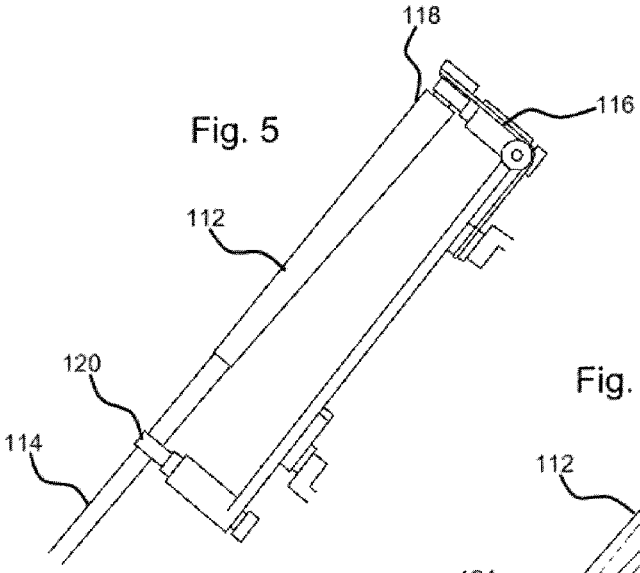
FIG. 5 is a side view of the club-like handle affixed to a carriage, in one form.
Figure 6:
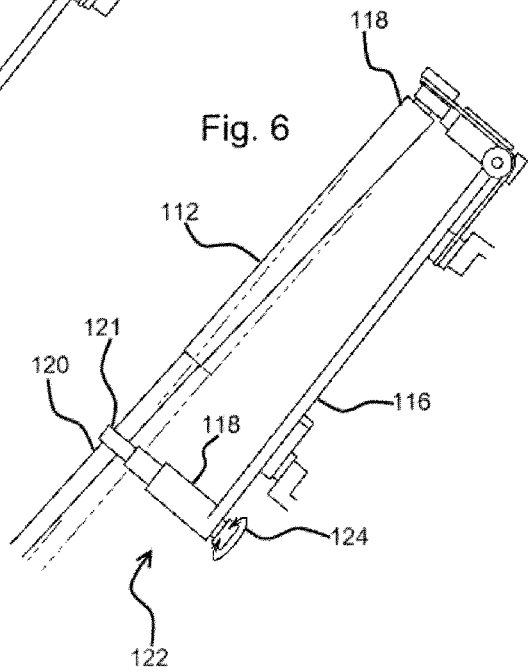
FIG. 6 is a side view of the club-like handle affixed to a carriage, in one form, showing a range of adjustments possible through the adjustment mechanism.

Looking to FIGS. 5 and 6, another improvement is conceived wherein the club-like handle 112 of the golf club-like device 114 is held within the carriage 116 in a novel fashion. Looking to FIG. 6, it can be seen how the handle 112 is attached at one end 118 to pivot relative to the carriage 116, and a median portion 120 is attached to rotate through a void in the post 121. An adjustment mechanism 122 is incorporated, comprising a rotating engagement portion 124, which allows the median portion 120 to reposition inward and outward, relative to the carriage 116. In one form, this comprises a plurality of threads within the barrel 118, connected in such a manner that as the engagement portion 124 rotates, the post 121 would not rotate.

Figure 7:
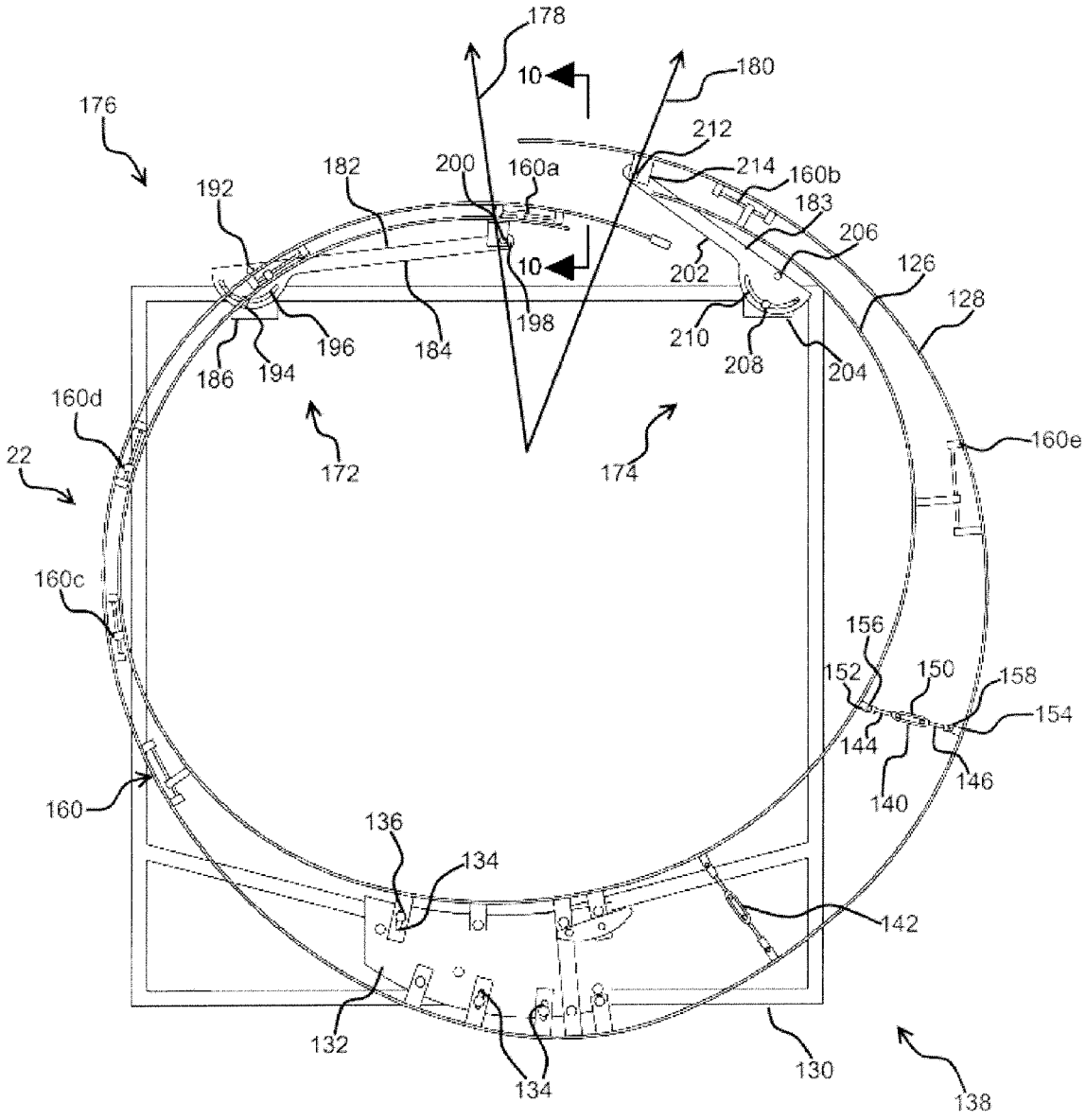
FIG. 7 is a plan view of one embodiment of an active area of a golf swing training device

Looking now to FIG. 7, a novel construction of the active area 22 is disclosed. The active area 22 generally comprises a first rail 126, positionably coupled to a second rail 128, operating in conjunction with an active rail frame 130. In one form, the first rail 126 and second rail 128 are attached to the rail frame 130 at several locations, including a frame attachment plate 132. As shown, to allow for adjustability of the rails relative to the frame attachment plate 132, a gap adjustment 134 is provided in several of these attachments wherein a fastener 136 can be partially released, allowing for adjustability of the gap adjustment 134 whereupon the fastener 136 is retightened. In one form, the fastener 136 is a threaded bolt, which threads into a threaded portion of the frame attachment plate 132.

In some regions around the circumference of the active area, it may be desired to easily and quickly adjust the gap between the first rail 126 and second rail 128. Thus, a gap adjustment system 138 is provided, which in one form, as shown, comprises a plurality of gap adjusters. FIG. 7 shows a first gap adjuster 140 and second gap adjuster 142, although other adjusters could be utilized. In this form, each of the gap adjusters substantially comprises a turnbuckle-like device, having a first left hand threaded portion 144 and a second right hand threaded portion 146 interconnected by a threaded barrel 150. Each end of the adjuster is mounted by way of mounting blocks 152 and 154, which are rigidly connected to the first rail 126 and second rail 128, respectively. Pivots 156 and 158 interconnect the respective adjuster with the respective attachment block. Thus, as the barrel 150 is rotated, the gap between the first block 152 and second block 154 alters, which would alter the pitch of the golf club at, and near, that place in the user's swing. At other locations, it may be desired that the relative distance between the first rail 126 and second rail 128 be maintained, even though the two rails require flexibility as the gap adjustments 134, 140 and 142 are altered. Thus, an attachment mechanism comprising a gap separation slide 160 is disclosed. The gap separation slide 160 can be modified and mounted at various locations about the active area, as shown in FIGS. 7-9.

Figure 10:
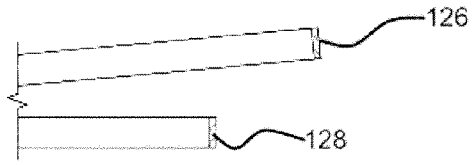
FIGS. 10 through 12 show the first rail and second rail in varying offset distances.
Figure 11:
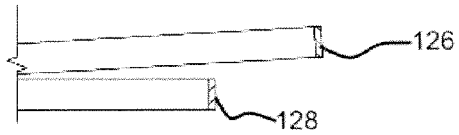
Figure 12:
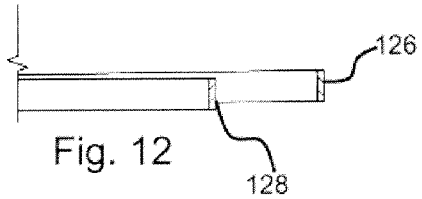
Figure 13:
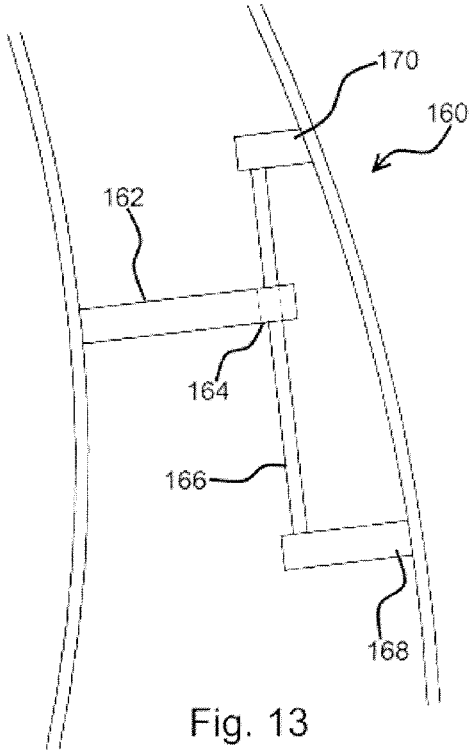
FIG. 13 is a detailed view of one embodiment of a gap separation slide.

In one form, the gap separation slides 160, as shown in the detail image of FIG. 13, comprise a first block 162 having a void 164 operatively configured to slide along a guide portion 166. In one form, the guide portion 166 is cylindrical, allowing for the first block 162 to slide and rotate about the guide portion 166. In one form, the guide portion 166 is mounted to the adjoining rail at a second block 168 and third block 170. As shown in FIGS. 10-12, the first rail 126 may not always be coplanar with the second rail 128, therefore, the guide portion 166 and void 164 may be arranged to allow for non-planar movement between the first rail 126 and second rail 128.

Figure 8:
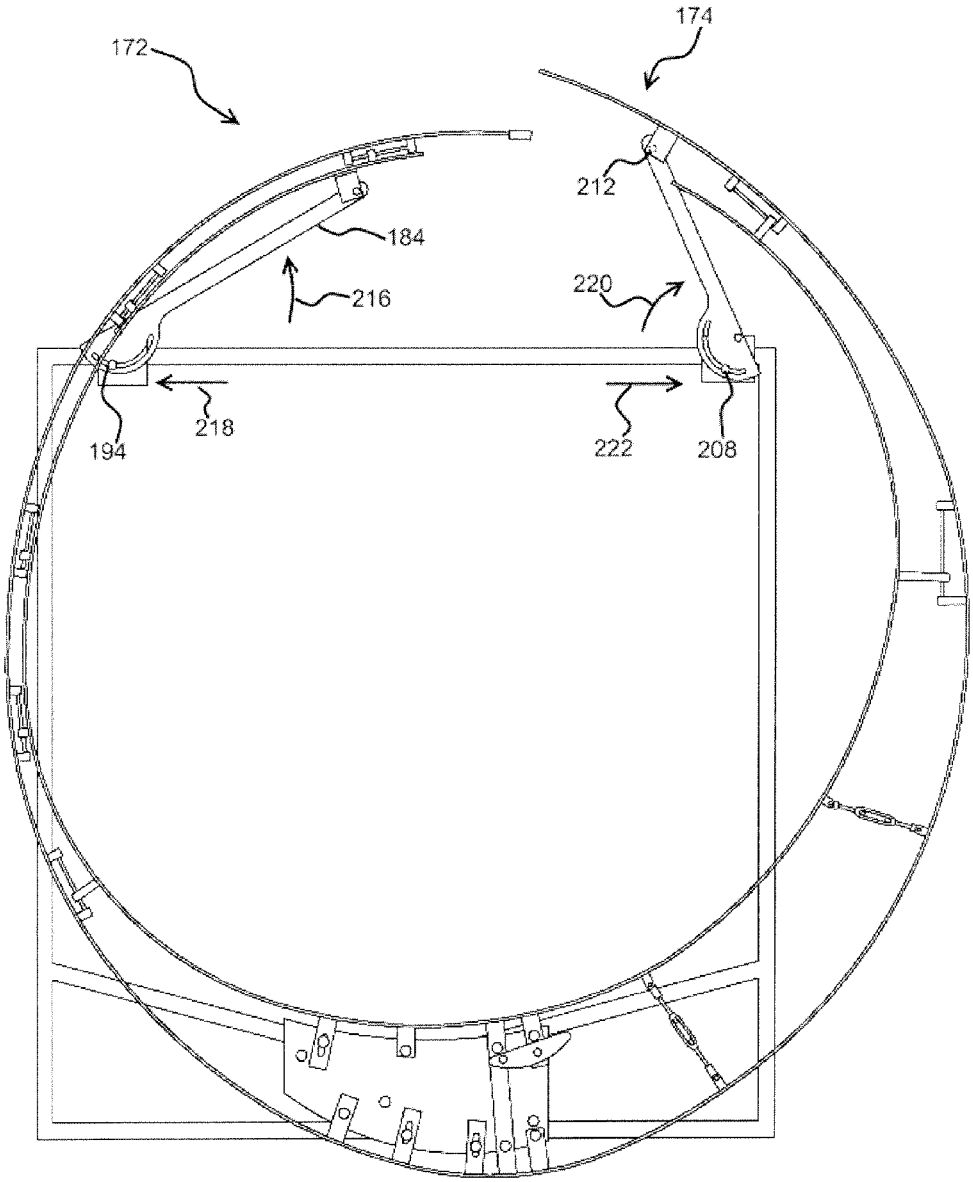
FIG. 8 is a plan view of the golf swing training device of FIG. 7 with the follow-through adjuster and back swing adjuster rotated radially outward.
Figure 9:
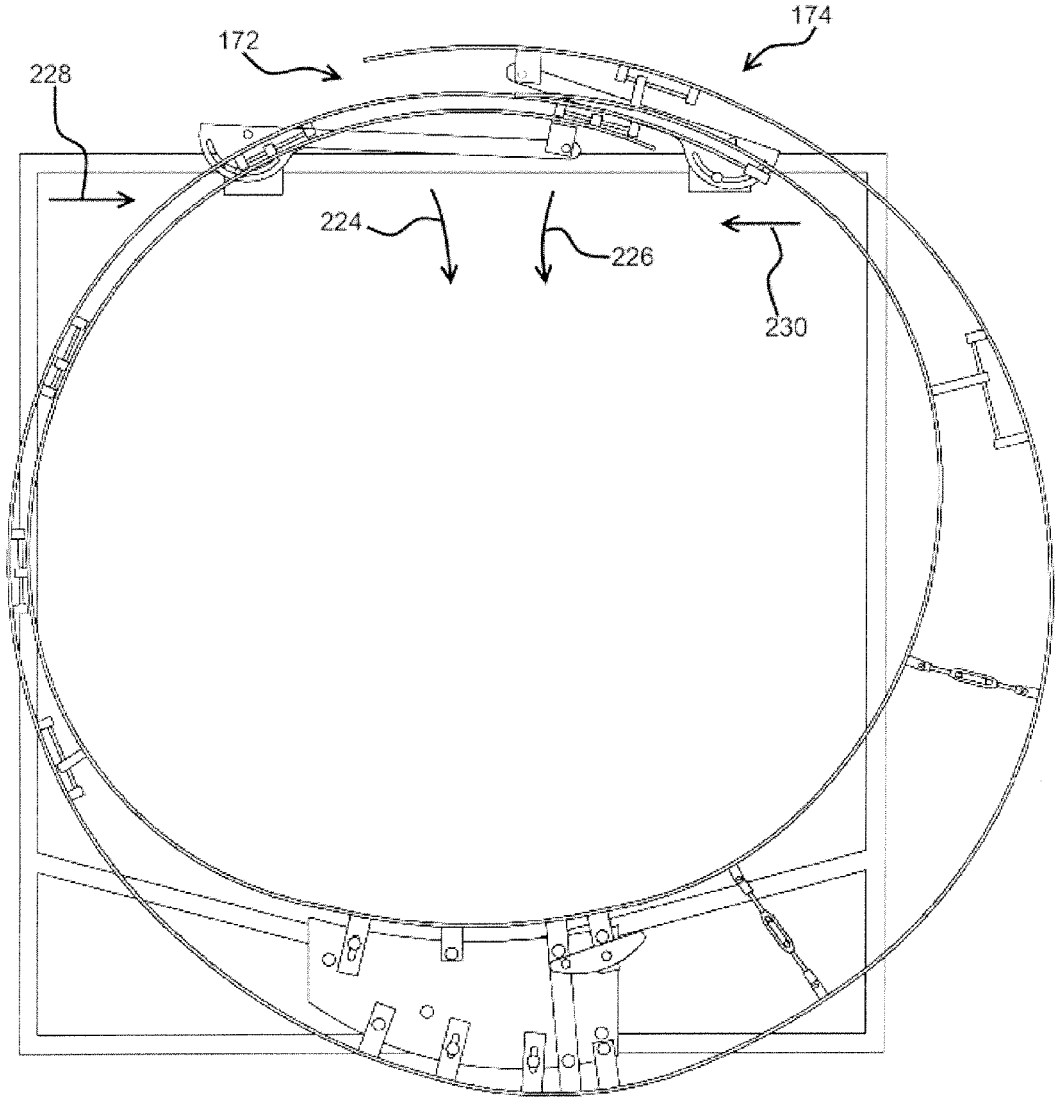
FIG. 9 is a plan view of the golf swing training device of FIG. 7 with the follow-through adjuster and backswing adjuster rotated radially inward.

Another adjustment system is shown in FIGS. 7-9, which allows for adjustability of the backswing portion 172 and follow through portion 174 of the active area or rail system 176. The rail system 176, comprising the first rail 126, second rail 128, gap adjusters 140, frame attachment plate 132, gap separation slides 160 and associated portions. The arrows 178 and 180 show a radially outward direction through which the backswing adjuster 182 and follow through adjuster 184 can be positioned. Beginning with the backswing adjuster 182, an adjustment bar 184 is attached to the rail frame 130 at a frame attachment 186. In one form, as shown in FIG. 2, the frame attachment 186 slideably engages the rail frame 130 and can be released and tensioned thereupon by a handle 190, such as a T-bolt, which clamps the frame attachment 186 to the rail frame 130 when tensioned. Returning to FIG. 7, the arm 184, in one form, is connected to the frame attachment 186 at a pivot 192 and lock 194. In one form, the lock 194 is a continuation of the handle 190, such that when the handle 190 is tensioned, the frame attachment 186 is not substantially permitted to slide along the rail frame 130, nor is the arm 184 permitted to rotate about the pivot 192. The lock 194 engages a channel 196, which is generally a semicircular channel centered upon the pivot 192. The outboard end 198 of the arm 184 comprises another pivot 200, which in this embodiment couples the first rail 126 through the pivot 200 to the adjustment arm 184. As previously discussed, the first rail 126 is coupled to the second rail 128 through a gap separation slide 160*a*.

The follow-through adjuster 183, in one form, also comprises also comprises an arm 202 attached to the rail frame 130 through a frame attachment 204, pivot 206 and lock 208, which engages a semicircular channel 210. Once again, the rail system 176 is attached to the follow-through adjuster 183 by attaching one of the rails to the arm 202. As shown, the second rail 128 is coupled through a pivot 212 and attachment block 214 to the arm 202, while the second rail 128 is coupled to the first rail 126 through a gap separation slide 160*b*.

Looking to FIG. 8, it can be seen how the lock 194 has been released, allowing the arm 184 to rotate radially outward along an arc 216 while simultaneously sliding in outward direction 218. When the desired backswing radius is achieved, the lock 194 is re-tensioned. Similarly, it can be seen that the follow-through portion 174 has been moved radially outward by releasing the lock 208, thus allowing the pivot 212 to rotate outward in direction 220 while simultaneously sliding outward along direction of travel 222. This would allow an instructor to greatly vary the swing of the student at the backswing portion 172 and also the follow-through portion 174.

FIG. 9 shows the backswing portion 172 and follow-through portion 174 rotated radially inward along rays or arcs 224 and 226, respectively, which also repositions the frame attachments along lines 228 and 230, respectively. This orientation could be utilized, for example, for smaller golf students or for golf students having shorter arms than would be supported by the arrangement shown in FIG. 8. This arrangement could also be beneficially used for transporting and storing the apparatus, as this provides a much smaller profile than the embodiment shown in FIGS. 7 and 8.

Figure 14:
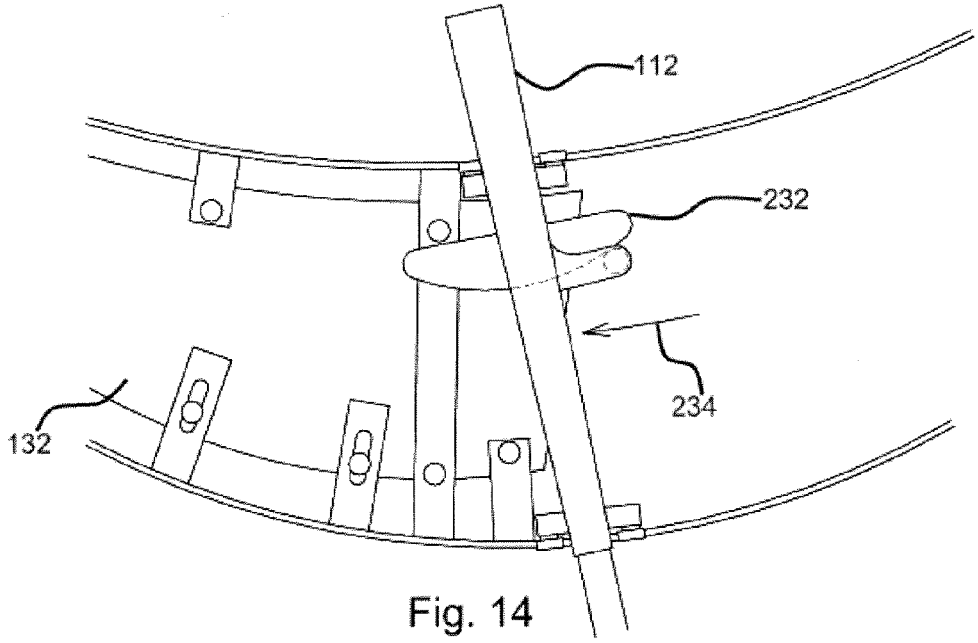
Figure 15:
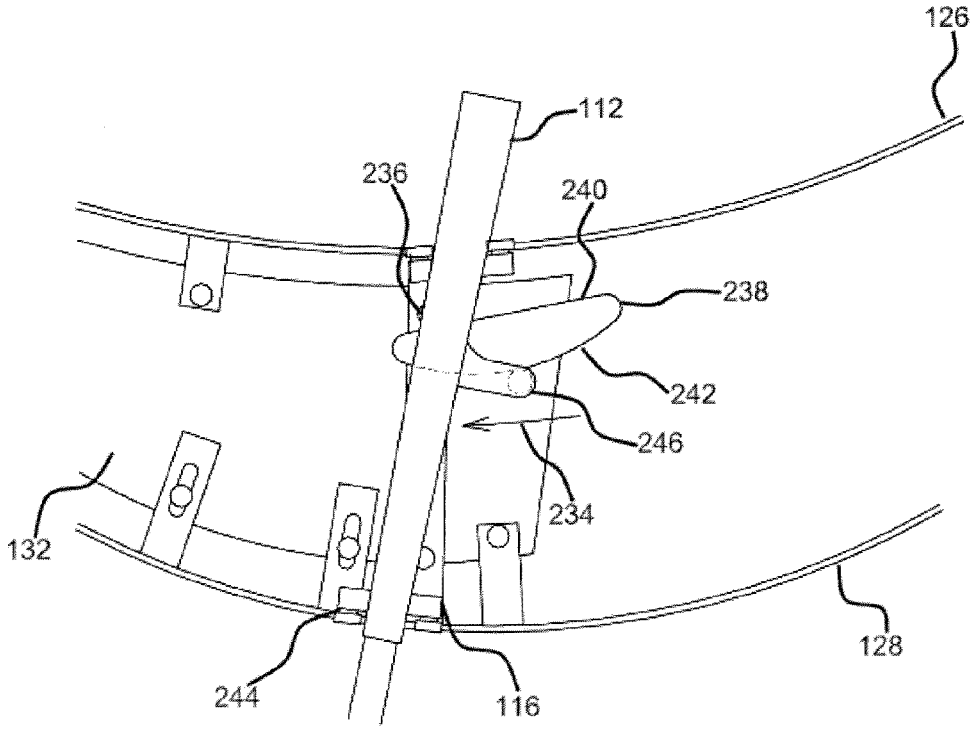

As a golf club is swung along the rail system 176, as shown in FIG. 7-9, it can be appreciated that in the backswing portion 172 the golf club is pitched rearwardly, whereas in the follow-through portion 174 the golf club is pitched forwardly. To accomplish this, a user will break his wrists substantially at the point at which the golf club encounters the ball. In one form, the carriage 116 of FIG. 5, and as described in detail in the previous patent application, the separation between the first rail 126 and second rail 128 will be substantially equal to the distance between the rollers on the carriage 116. Thus, it would be possible for the user to incorrectly over rotate, thus having the golf club in the incorrect pitch orientation in the follow-through portion 174. Is also more likely, and less detrimental, when the user is resetting the device, to over-correct when the golf club is returned backwards through the system from the follow-through portion 174 through the backswing portion 172, and to improperly pitch the golf club, which would make it impossible to have a correct swing on the next attempt. Thus, as shown in FIGS. 14 and 15, an over-swing protector 232 may be provided upon the frame attachment plate 132. In one form, the over swing protector 232 is made from a solid piece of material, preferably a material having a very low coefficient of friction such as nylon, Delran, or Teflon. Thus, as the golf club-like handle 112 is repositioned in direction 234 to reset the device, an upper roller 236 will contact the leading edge 238 of the over-swing protector 232, unless the golf club-like handle 112 is correctly aligned. The leading edge 238 will require that the upper roller 236 engage either the upper surface 240 or lower surface 242 of the over-swing protector 232 in order to continue in the direction of reset swing 234. If the golf club-like handle 112 is rotated such that the upper roller 236 would engage the lower surface 242, this would result in an incorrect pitch angle. Thus, it is provided that in this orientation, the golf club-like handle 112 would not be allowed to rotate, as the upper roller 236 engaging the lower surface 242 would press the lower rollers 244 of the carriage assembly 116 against the second rail 128 in compression. This would jam the device and would not allow the handle to continue along direction of reset swing 234.

Figure 16:
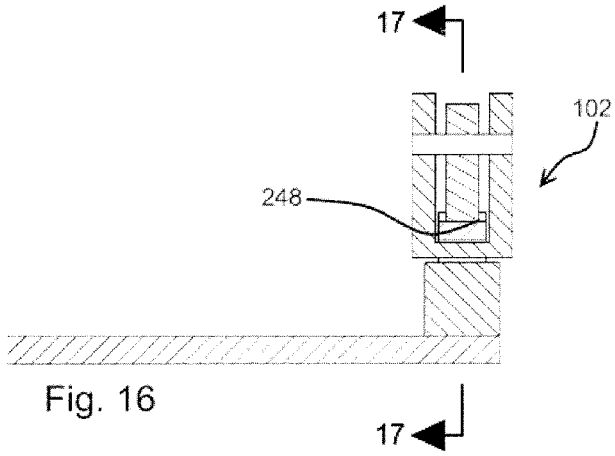
FIG. 16 is a detailed cutaway view of a gear rack adjustment taken along line 16-16 of FIG. 1.
Figure 17:
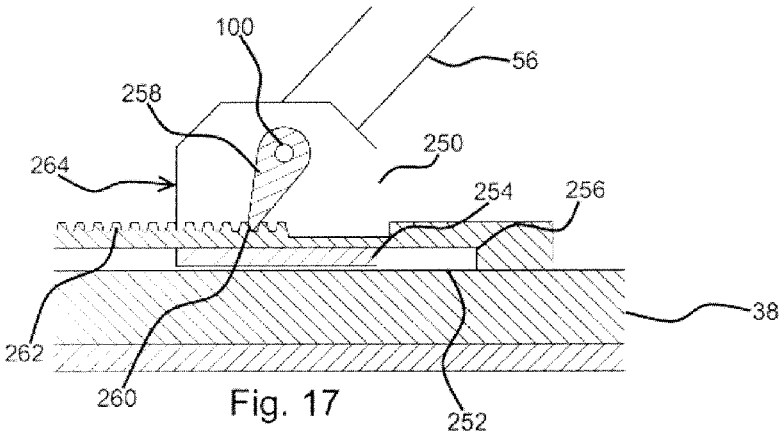
FIG. 17 is a cutaway view of one embodiment of a gear rack adjustment in one form.
Figure 18:
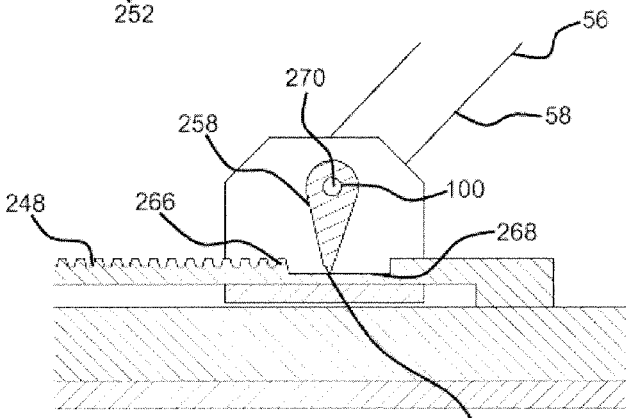
FIG. 18 is a cutaway view of one embodiment of a gear rack adjustment with the pawl adjacent the reset trough.
Figure 19:
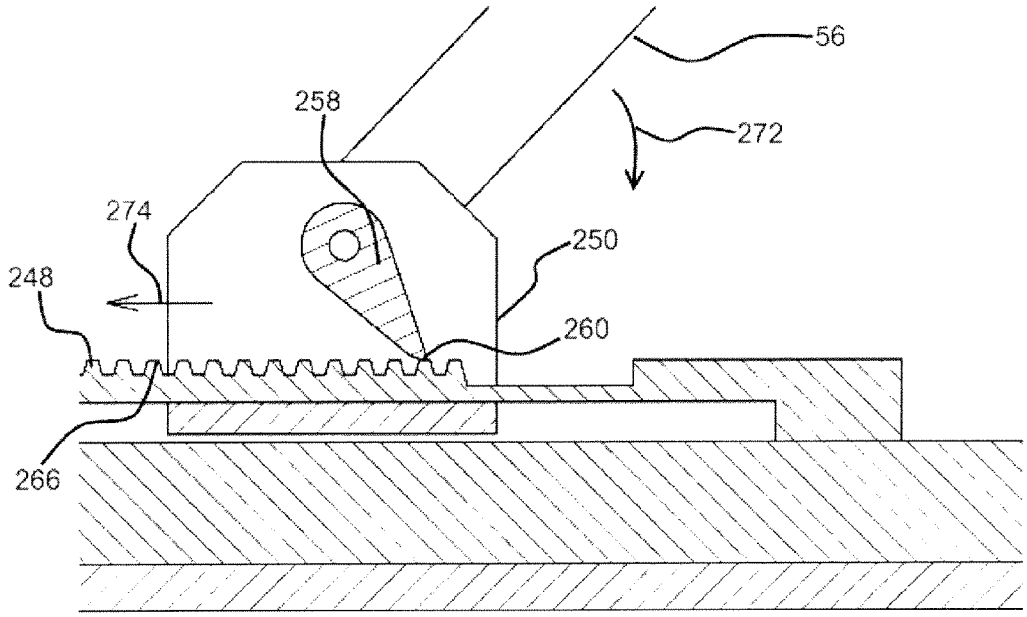
FIG. 19 is a cutaway view of one embodiment of a gear rack adjustment with the pawl engaging the gear rack.

With the weight of the combined apparatus above the base platform 38 pressing down upon the linkage members and pivots, the golf swing device 20 in one form may tend toward the fully lowered/collapsed orientation 34, shown in FIG. 4. However, the gas spring 88 or similar apparatus could be used to assist the entire golf swing device 20 into a fully upright orientation 28, as shown in FIG. 1, if the gas spring 88 has sufficient compressive strength. In one form, the gas spring 88 will not comprise sufficient extensive compressive force to overcome the weight of the apparatus, and thus the entire device will tend toward the fully lowered/collapsed orientation 34. To counter this compressive force and to allow for a wide range of adjustability, the slide 102 may be coupled to a gear rack 248, as shown in FIG. 1, and detailed in FIGS. 16-18. In this arrangement, the slide 102 comprises the pivot 100 between the base platform 38 and second linkage 56. As shown, the pivot 100 connects to the base platform 38 through a slide attachment block 250, which slides upon the upper surface 252 of the base platform 38 and in one form comprises a flange 254, which rides below a lower surface 256 of the gear rack 248. A pawl 258 is also rotatably coupled to the slide attachment block 250, in one form through the pivot 100, although other pivots could be utilized. The pawl 258 comprises an engagement point 260, which engages the teeth and grooves 262 of the gear rack 248. This arrangement offsets the net downward force of the weight of the golf swing device 20, forcing against the gas spring 88. Thus, as the active area 22 is engaged, the slide block 250 will reposition in direction of travel 264, engaging the correct gear or tooth for the desired height. Looking to FIG. 18, the golf swing device 20 has been raised beyond the fully upright orientation 28, such that the point 260 of the pawl 258 has gone beyond the last tooth 266 of the gear rack 248 and is adjacent the base of trough 268. As the distance between the center 270 of pivot 100 and the upper surface of the base of trough 268 is greater than the length the pawl from the center 270 of pivot 100 to the end of the point 260, the pawl 258 will no longer engage any portion of the gear rack 248 when in the trough. Looking to FIG. 19, it can be seen how as the active area 22 is lowered, the second linkage 56 will rotate in downward arc 272 as the slide attachment block 250 repositions laterally along line of travel 274. The point 260 of the pawl 258 will then engage the teeth 266 of the gear rack 248 until the pawl reaches a second trough at the forward end of the gear rack, as shown in FIG. 4. Thus, once again the pawl 258 will be positioned as shown in FIG. 18, and the cycle will be repeated, such that as the active area 22 is raised, the pawl 258 will engage successive teeth of the gear rack 248 until the desired height is achieved.

Figure 20:
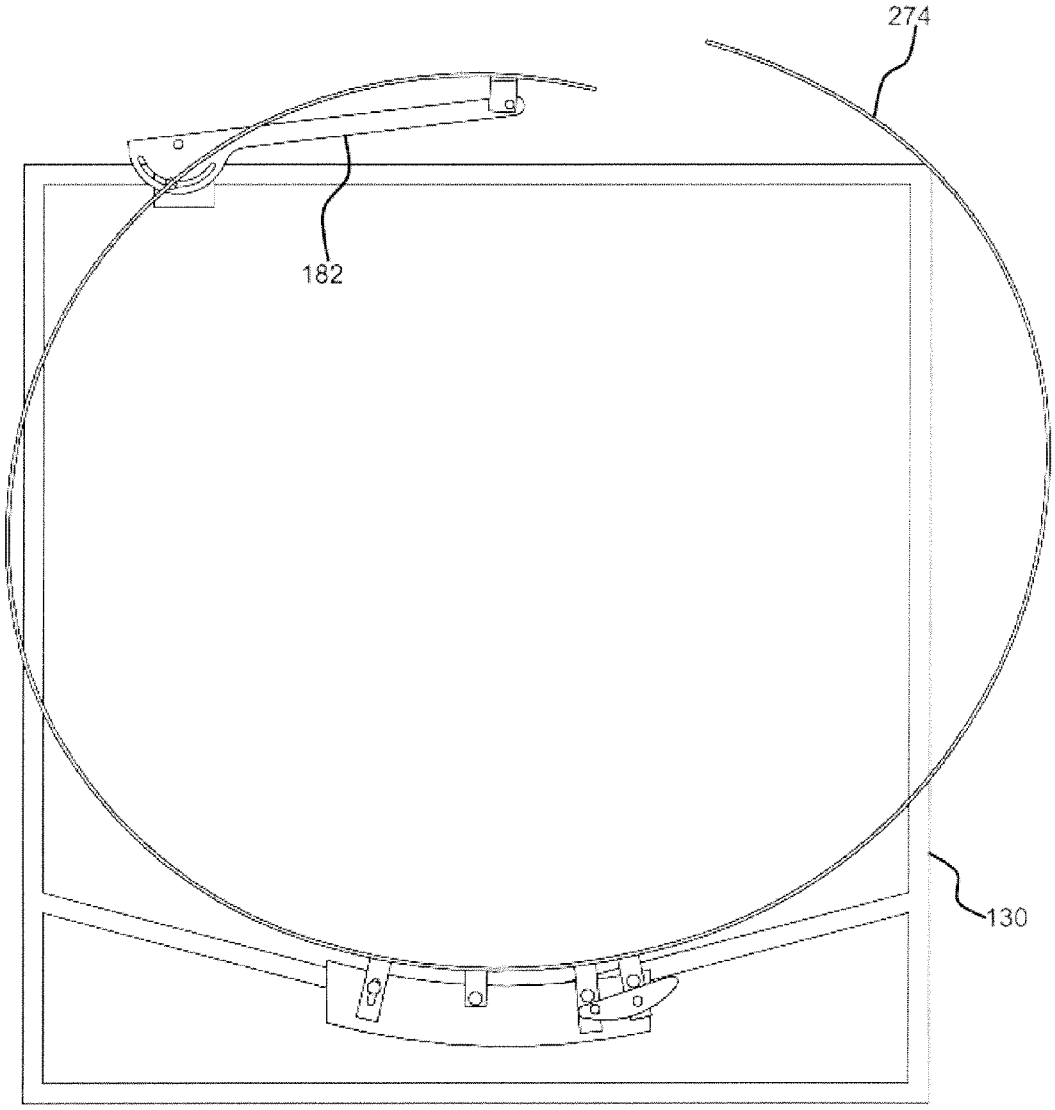
FIG. 20 is a plan view of a single rail embodiment.

While the previous embodiments disclose an active area 22 comprising a plurality of rails, in this case a first rail 126 and a second rail 128, the rail system 176 could also comprise a single rail arrangement, as shown in FIG. 20, comprising a single rail 274. Additionally, the embodiment is shown with a single backswing adjuster 182, wherein the follow-through adjuster 183 is not utilized. In this embodiment, it may be possible to have the follow-through portion 174 directly coupled to the rail frame 130. Of course, modifications would be required to the carriage 116 for proper use of this embodiment.

Returning to FIGS. 2 and 3, an angular adjustment system 276 is shown, generally comprising an adjustment screw 278 coupled to a threaded portion 280 of a pivot 282. A second pivot 284 is shown, which is coupled to allow rotation but perhaps not translational movement of the adjustment screw 278. A handle 286 may be included to allow for easy rotation of the adjustment screw 278. As can be seen, the lower portion 288 of the adjustment screw 278 is nearly entirely exposed in FIG. 2, whereas in FIG. 3 a large portion of the screw 278 is shown between the fourth linkage 74 and the rail frame 130. Thus, as the adjustment screw 278 rotates, it translates or moves laterally through the threaded portion 280, moving the pivot 284 relative to the pivot 282, in direction of travel 290, about pivot 292, coupled between the cross arm 82 and the rail frame 130. This allows for a wide range of angular adjustability as the device is in use.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A collapsible, and adjustable frame for a golf swing training device having an active area, the collapsible frame comprising:

a. a base platform operatively configured to rest on a support surface;

b. a first linkage having a first end, a second end and a medial portion, wherein the first end of the first linkage is rotatably coupled to the base platform;

c. a second linkage having a first end and a second end, wherein the first end of the second linkage is slidably and rotatably coupled to the base platform and the second end of the second linkage is rotatably coupled to the medial portion of the first linkage;

d. a third linkage having a first end, a second end, and a medial portion, wherein the first end of the third linkage is rotatably coupled to the median portion of the second linkage, wherein the third linkage is substantially parallel to the first linkage;

e. a fourth linkage having a first end, a medial portion, and a second end wherein the first end of the fourth linkage is coupled to the second end of the third linkage, and the medial portion of the fourth linkage is coupled to the active area of the golf swing training device; and f. wherein the collapsible frame supports a rail frame of the active area of the golf swing training device and provides vertical adjustability between the support surface and the rail frame.

2. The collapsible frame for a golf swing training device as recited in claim 1 further comprising an adjustable linkage mechanism between the active area of the golf swing training device and the medial portion of the fourth linkage.

3. The collapsible frame for a golf swing training device as recited in claim 2 wherein the adjustable linkage comprises a threaded rod.

4. The collapsible frame for a golf swing training device as recited in claim 1 wherein the rail frame of the active area forms a plane at an angle of between 50 and 70 degrees from the angle of the support surface when in a fully upright position and wherein the active area is substantially parallel to the support surface when in a fully lowered position.

5. The collapsible frame for a golf swing training device as recited in claim 1 further comprising a gas spring operatively configured to offset the weight of the active area as the height of the collapsible frame is adjusted.

6. The collapsible frame for a golf swing training device as recited in claim 5 further comprising a. a release catch which retains the golf swing training device in the storage position when the release catch is engaged; and b. wherein the release catch couples the rail frame to the base frame when engaged.

7. The collapsible frame for a golf swing training device as recited in claim 1 further comprising a cross member having a first end, a medial portion and a second end;

a. wherein the medial portion of the cross member is fixedly coupled to the medial portion of the fourth linkage;

b. wherein the first end of the cross member is rotatably coupled to the second end of the first linkage; and, c. wherein the second end of the cross member is rotatably coupled to the active area.

8. The collapsible frame for a golf swing training device as recited in claim 1 further comprising:

a. a gear rack mounted to the base platform, and b. a pawl rotatably mounted to the collapsible frame operatively configured to engage the gear rack and maintain the active area in a desired vertical position.

9. The collapsible frame for a golf swing training device as recited in claim 1 further comprising:

a. a frame attachment slide positionably coupled to the rail frame;

b. a backswing adjuster rotatably coupled to the frame attachment slide; and c. wherein the backswing adjuster is coupled to at least one rail of the active area.

10. The collapsible frame for a golf swing training device as recited in claim 1 further comprising:

a. a frame attachment slide positionably coupled to the rail frame;

b. a follow through adjuster rotatably coupled to the frame attachment slide; and c. wherein the follow through adjuster is coupled to at least one rail of the active area.

11. A golf swing apparatus adapted to train a golf student with a golf swing of the golf student where a golf swing of the student having rearward and forward swing directions and having various swing positions, the golf swing apparatus comprising:

a. a frame arranged to support a first rail and a second rail, b. the first and second rails defining a swing plane, c. a carriage having a first attachment region and a second attachment region where the first attachment region is arranged to be slidably attached to the first rail and the second attachment region is arranged to be slidably attached to the second rail, d. the first and second attachment regions being positioned at a substantially fixed distance from one another on the carriage, e. the carriage further operatively configured to receive a golf club like handle having an upper connection portion pivotally attached to the first attachment region of the carriage and a lower connection portion pivotally connected to the second attachment region, f. the carriage being arranged to reposition in a rearward swing direction and a forward swing direction whereby the distance between the first rail and the second rail in the swing plane fluctuates with respect to the location of the carriage at various swing positions whereby said distance between the first and second rail at various swing positions dictates the pitch of the carriage and handle substantially about a forward-rearward axis providing the golf student with a desired golf swing, and g. at least one gap adjuster having a first portion coupled to the first rail and a second portion coupled to the second rail wherein the distance between the first portion and the second portion can be adjusted.

12. The golf swing apparatus as recited in claim 11 further comprising:

a. at least one gap separation slide comprising:

i. a first portion fixed to the first rail, ii. a second portion fixed to the second rail, and iii. a guide portion allowing the first portion and second portion to reposition relative to one another along an axis substantially parallel to the tangent of the second rail at the second portion.

13. The golf swing apparatus as recited in claim 11 further comprising:

a. a first frame attachment slide coupled to the frame;

b. a backswing adjuster rotatably coupled to the first frame adjustment slide and coupled to the first rail or second rail at a backswing portion of the golf swing apparatus;

c. a second attachment slide coupled to the frame; and d. a follow-through adjuster rotatably coupled to the coupled to the second frame adjustment slide and coupled to the first rail or second rail at a follow-through portion of the golf swing apparatus.

14. The golf swing apparatus as recited in claim 11 further comprising:

a. an overswing preventer coupled to the rail frame;

b. at least one roller coupled to the carriage; and c. wherein the roller engages the overswing preventer to prevent the carriage from incorrectly engaging the first and second rails.

* * * * *